US008348267B2

(12) United States Patent
Storey et al.

(10) Patent No.: US 8,348,267 B2
(45) Date of Patent: Jan. 8, 2013

(54) MEDIA ROTATION AND TRANSLATION APPARATUS

(75) Inventors: Matthew M Storey, Rochester, NY (US); Adam D Ledgerwood, Geneva, NY (US); Aaron M Moore, Fairport, NY (US); Derek A Bryl, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 81 days.

(21) Appl. No.: 13/030,514

(22) Filed: Feb. 18, 2011

(65) Prior Publication Data

US 2012/0211939 A1 Aug. 23, 2012

(51) Int. Cl.
*B65H 7/02* (2006.01)
*B65H 9/04* (2006.01)

(52) U.S. Cl. ..... 271/254; 271/228

(58) Field of Classification Search ..... 271/226–228, 271/252–254

See application file for complete search history.

(56) References Cited

U.S. PATENT DOCUMENTS

| | | | | |
|---|---|---|---|---|
| 4,203,588 | A * | 5/1980 | Joosten | 271/246 |
| 5,280,901 | A * | 1/1994 | Smith et al. | 271/188 |
| 5,402,996 | A * | 4/1995 | Long | 271/9.07 |
| 5,697,609 | A * | 12/1997 | Williams et al. | 271/228 |
| 5,749,294 | A * | 5/1998 | Ruf et al. | 101/232 |
| 6,053,494 | A * | 4/2000 | Baskette et al. | 271/251 |
| 6,634,521 | B1 * | 10/2003 | Hwang | 221/228 |
| 6,811,152 | B2 | 11/2004 | Delfosse et al. | |
| 2003/0057637 | A1 * | 3/2003 | Kawamura et al. | 271/227 |

* cited by examiner

*Primary Examiner* — Patrick Cicchino

(57) ABSTRACT

An improved media rotator/translator apparatus includes a cylinder on sphere nip. A series of beveled/spur gears are included, one of which rotates co-axially but independent to the drive roll shafts. This enables the drive rolls to be driven about their own axis while simultaneously allowing for rotation about the roll shaft axis. A ball idler is positioned above each drive roll providing media normal force. Thus, sheet translation, jogging, and rotation is obtained, but with no relative motion, thereby eliminating marking of certain media.

13 Claims, 3 Drawing Sheets

MEDIA ROTATION AND TRANSLATION APPARATUS

CROSS REFERENCE TO RELATED APPLICATIONS

Cross-reference is hereby made to commonly assigned and copending U.S. application Ser. No. 13/030,503, filed Feb. 18, 2011, and entitled "MEDIA ROTATION AND TRANSLATION MECHANISM" by Derek Albert Bryl, et al. The disclosure of the heretofore-mentioned application is incorporated herein by reference in its entirety.

BACKGROUND

1. Field of the Disclosure

The present disclosure relates broadly to a finisher transport module system, and more particularly, to an improved rotator and translator apparatus for use in controlling the orientation and alignment of media passing through a finisher transport module.

2. Description of Related Art

Finishing transport module systems for rotating and translating sheets passing through the system are known, for example, U.S. Pat. No. 6,811,152 which is incorporated herein by reference along with the references cited therein. Another example is shown in prior art FIG. 1, where a sheet rotator and translator mechanism for a finishing transport module 10 includes two rotator disc motors 30 and 30 that drive each rotator disc 12 and 14 independently. When turning in the same direction and at the same speed, a sheet will pass through the rotator device like any normal nip set (no rotation or directional offset). With the motors still rotating in the same direction and speed, steering idlers 16 and 18 can be rotated around the periphery of the discs to alter the inboard/outboard position of a sheet without rotation. This is useful for offsetting sheet sets in a stacker or for changing center and edge registration for finishing devices located downstream. To know when the sheet has been offset the desired amount, there is an edge sensor 40 that is positionable by a lead screw. A motor 33 connected to the lead screw positions the sensor 40 a set distance inboard/outboard for one sheet set, then repositions the sensor to detect the inboard/outboard position for the next sheet set. For sheet rotation, the motors controlling the rotator discs simply spin at different velocities. The larger the velocity differential, the faster the media is rotated.

A problem with this design is that the discs spin horizontally while the idlers spin vertically. To prevent excessive relative motion (in the cross process direction) each disc has a sharp lip for a contact point with the idler. The high pressure nip is shown in prior art FIG. 1 and includes a very small contact point 13 between the disc 12 and the idler 18, as well as, a sharp contact point 15 between disc 14 and idler 16. This effectively removes the relative motion since there is essentially only one radius, but the pressure is very high. This high pressure is necessary to prevent slip, but ultimately does cause marking on certain media, especially coated sheets.

Thus, there is still a need for a solution to the excessive relative motion problem of existing finishing transport module systems that would eliminate marking of certain types of media.

BRIEF SUMMARY OF THE DISCLOSURE

Accordingly, in answer to the above-mentioned problem and disclosed herein is an improved rotator/translator apparatus that includes shaft mounted drive roll cylinder on sphere nips. A series of beveled/spur gears are included, one of which rotates co-axially but independent to the drive roll shafts. This enables the drive rolls to be driven about their own axis while simultaneously allowing for rotation about the roll shaft axis. A ball idler is positioned above each drive roll providing the required normal force to drive sheets in any direction required. Thus, sheet translation, jogging, and rotation is obtained, but with no relative motion and a larger nip surface area, thereby eliminating marking of certain media.

BRIEF DESCRIPTION OF THE DRAWINGS

Various of the above-mentioned and further features and advantages will be apparent to those skilled in the art from the specific apparatus and its operation or methods described in the example(s) below, and the claims. Thus, they will be better understood from this description of these specific embodiment(s), including the drawing figures (which are approximately to scale) wherein:

DETAILED DESCRIPTION OF THE PREFERRED EMBODIMENT

Figure 1:
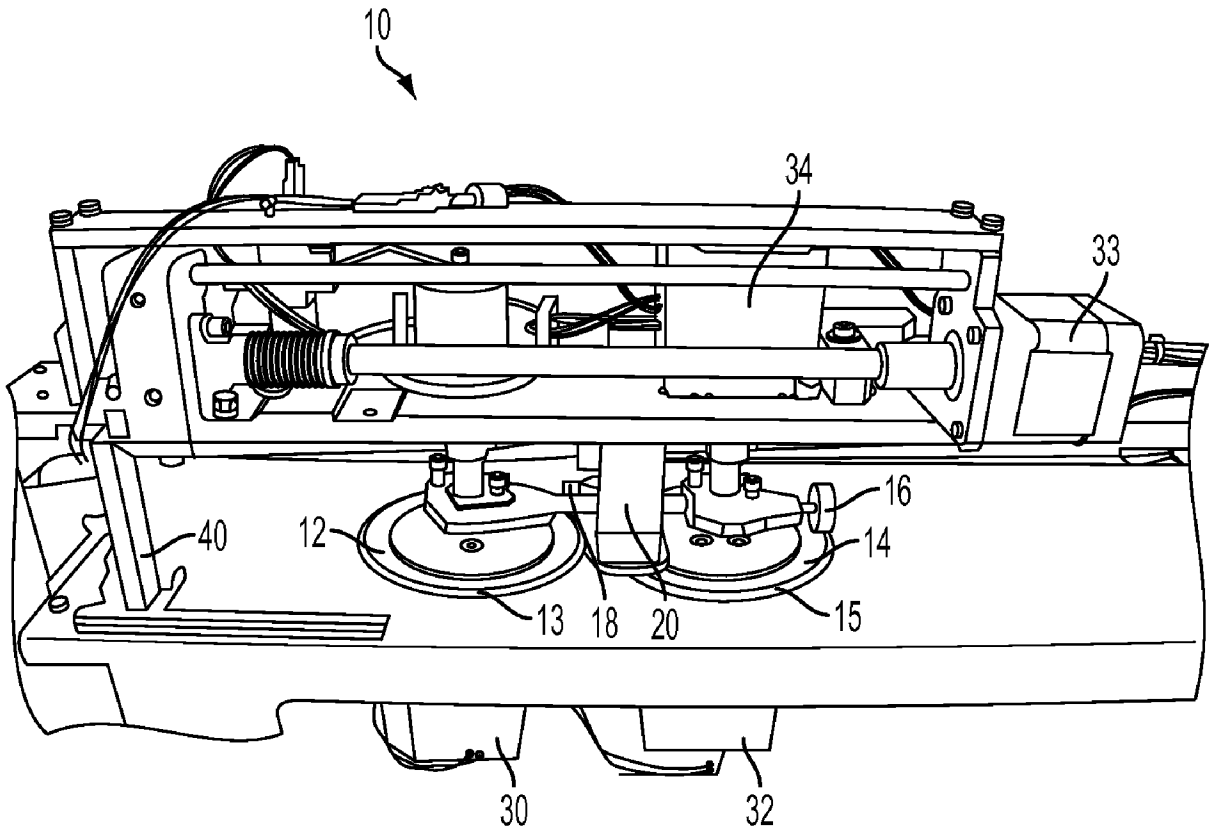
FIG. 1 PRIOR ART
FIG. 1 is a partial frontal view of a prior art sheet rotator/translator mechanism for use in a finisher transport module.
Figure 2:
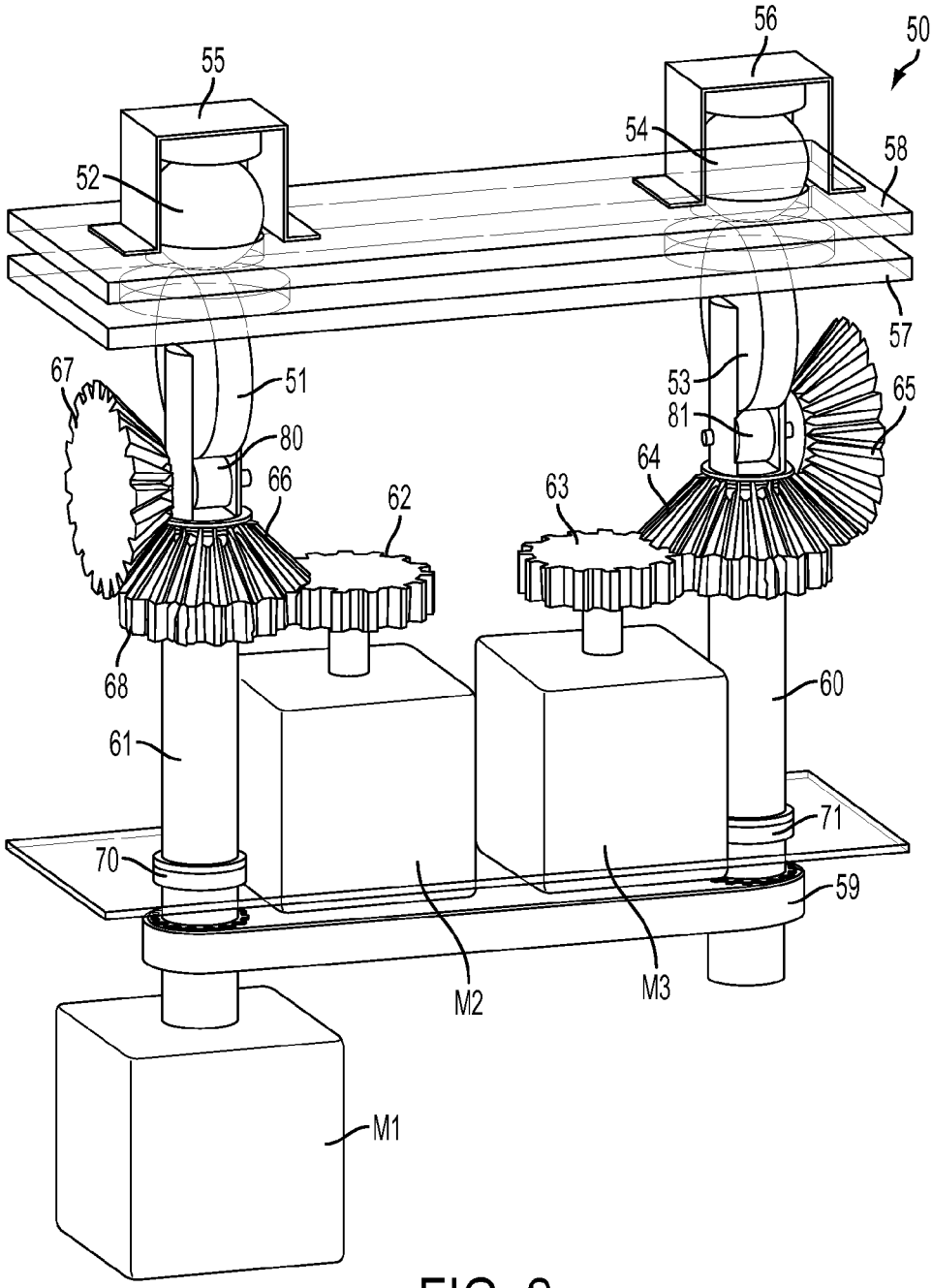
FIG. 2 is a partial perspective view of an improved sheet rotator/translator mechanism in accordance with the present disclosure.

Turning now to the drawings wherein the showings are for the purpose of illustrating an exemplary embodiment and not intended as a limitation, FIG. 2 illustrates a partial perspective view of an improved sheet rotator/translator mechanism in accordance with the present disclosure for accomplishing the sheet rotation and translation in a finisher transport module system without media marking.

A number of existing finishing transport module systems employ a media rotation and translation mechanism that utilizes two disc/idler pairs for re-registering conveyed sheets from center to side registration. However, the nip width between the disc and idler is thin relative to the diameter of the disk to avoid slippage, but the resulting high nip pressure has caused marking on coated media. In accordance with the present disclosure, the disc and flat idler nip combination employed heretofore to manipulate sheets in feeder transport modules has been replaced with a pair of cylindrical drive rolls with opposing spherical idlers.

Figure 3:
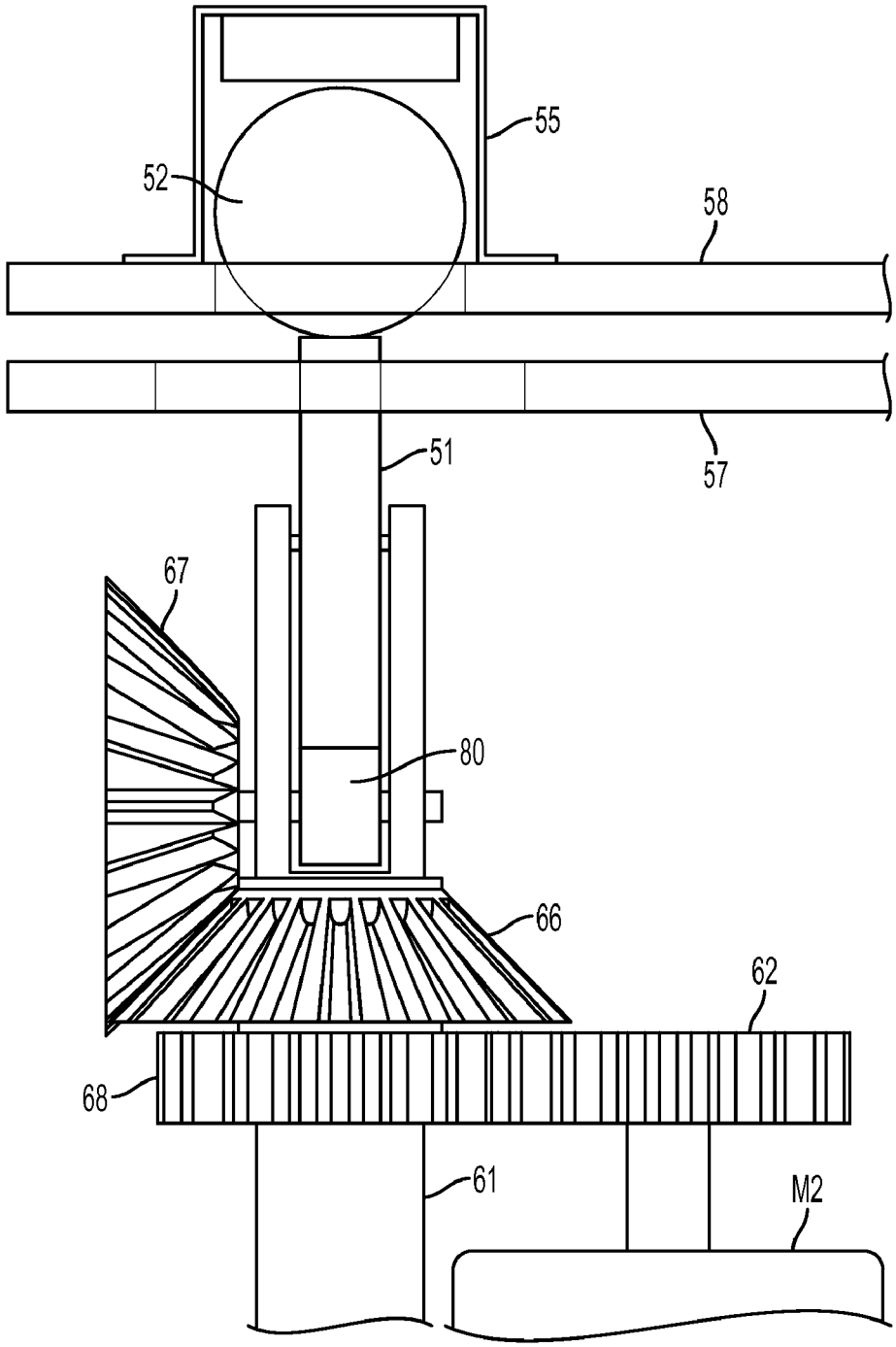
FIG. 3 is a partial frontal view of the bevel gear arrangement of the improved sheet rotator/translator mechanism shown in FIG. 2.

As shown in FIGS. 2 and 3, a sheet rotator/translator mechanism 50 eliminates the relative motion and the need for a high pressure contact nip by including at least two cylindrical drive rolls 51 and 53 that form nips with opposing spherical idlers 52 and 54 housed in containers 55 and 56 with sheets passing between support members 57 and 58. The ball idlers are positioned above each drive roll to provide the required normal force to drive sheets in any direction. Cylindrical drive rolls 51 and 53 are supported for rotation by motor M1 about a vertical axis on rotatable shafts 60 and 61 that pivot on bearings 70 and 71. Cylindrical drive rolls 51 and 53 are driven in a horizontal plane by intermediate drive rolls 80 and 81 through spur gears 62 and 63 powered by motors M1 and M2.

More specifically, and as seen in FIG. 3, a bevel/spur gear combination 66, 68 is affixed to the shaft 61, but allowed to rotate independently. Spur gear 68 and bevel gear 66 are driven by spur gear 62 connected to motor M2 and the direction of this power transmission is then shifted 90 degrees by contact of the conical section of bevel gear 66 with bevel gear 67. This drives drive roll 51 through contact pressure with intermediate roll 80. Because the bevel/spur gear (66, 68) is co-axial with the drive roll shaft 61, the drive roll 51 and shaft 61 can be rotated about a vertical axis while the drive roll is still being driven on its own axis by spur gear 62. As drive roll shaft 61 rotates, drive roll 51 will speed up or slow down accordingly; therefore, the speed of motor M2 connected to spur gear 62 is adjusted accordingly with firmware code.

It should now be understood that an improved rotator/translator mechanism has been disclosed for use in a finishing transport module system that eliminates relative motion and the need for a high pressure contact nip by using a cylinder on sphere nip. It uses a series of beveled gears, one of which rotates co-axially but independent to the drive roll shafts. This enables the drive rolls to be driven about their own axis while simultaneously allowing for rotation about the roll shaft axis. A ball idler is positioned above each drive roll providing the normal force to drive the sheet in any direction required. Advantageously, the drive rolls are driven about their center while being allowed to simultaneously rotate about their vertical axis independently. Independent drive roll velocities allow for paper rotation, while vertical axis rotation allows for paper translation. Thus, sheet translation, jogging, and rotation are accomplished with no relative motion and a larger nip surface area, thereby eliminating marking of certain media.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A finisher transport module includes an improved rotator and translator mechanism for use in controlling the orientation and alignment of media passing through said finisher transport module, comprising:

a pair of cylindrical drive rolls over which said media passes, and wherein each of said drive rolls is in contact with and driven by intermediate rolls, and wherein each of said intermediate rolls is connected to a first beveled gear;

shafts for supporting each of said drive rolls;

spherical idler rolls forming nips with each of said cylindrical drive rolls; and an arrangement connected to said shafts for rotating said cylindrical drive rolls in horizontal and vertical planes.

2. The mechanism of claim 1, wherein said first beveled gear is drivingly connected to a second beveled gear positioned coaxially on each of said shafts.

3. The mechanism of claim 2, including a first spur gear connected to said second beveled gear and coaxially mounted on each of said shafts.

4. The mechanism of claim 3, including a second spur gear drivingly connected to said first spur gear with said second spur gear being rotatably driven by a first motor connected thereto.

5. The mechanism of claim 4, including a second motor drivingly connected to said shafts that support each of said drive rolls for rotating each of said drive rolls in a vertical plane in unison.

6. The mechanism of claim 5, wherein said shafts supporting each of said drive rolls are driven by separate motors.

7. A method for controlling the orientation and alignment of media passing through a finisher transport module, comprising:

providing a pair of shaft mounted cylindrical drive rolls over which said media passes and wherein each of said drive rolls is in contact with and driven by an intermediate roll, and wherein each of said intermediate rolls is connected to first beveled gears;

providing spherical idler rolls forming nips with said drive rolls; and providing an arrangement connected to said shafts for rotating said cylindrical drive rolls in horizontal and vertical planes.

8. The method of claim 7, including said arrangement wherein said first beveled gears are drivingly connected to second beveled gears positioned coaxially on said shafts.

9. The method of claim 8, wherein said arrangement includes first spur gears connected to said second beveled gears and coaxially mounted on each of said shafts.

10. The method of claim 9, wherein said arrangement includes second spur gears drivingly connected to said first spur gears with said second spur gears being rotatably driven by separate motor connected thereto.

11. The method of claim 10, wherein said arrangement includes a third motor drivingly connected to said shafts that support each of said drive rolls for rotating each of said drive rolls in a vertical plane in unison.

12. The method of claim 7, wherein said arrangement includes said shafts of said drive rolls being driven by separate motors.

13. The method of claim 7, including rotating said drive rolls about their own axis and about a vertical axis while nip force is simultaneously being provided by said spherical idler rolls.

* * * * *